United States Patent [19]

Rosser et al.

[11] 4,440,819

[45] Apr. 3, 1984

[54] INTERCONNECTION OF UNIDIRECTIONAL FIBER ARRAYS WITH RANDOM FIBER NETWORKS

[75] Inventors: Robin W. Rosser, Santa Monica; Leon B. Keller, Palos Verdes Estates, both of Calif.

[73] Assignee: Hughes Aircraft Company, El Segundo, Calif.

[21] Appl. No.: 453,429

[22] Filed: Dec. 27, 1982

[51] Int. Cl.[3] ..... B32B 5/08; B32B 5/10; B32B 5/26; B32B 5/28

[52] U.S. Cl. ..... 428/107; 264/23; 264/236; 428/109; 428/110; 428/257; 428/272; 428/273; 428/288; 428/290; 428/294; 428/296; 428/902

[58] Field of Search ..... 264/23, 236; 528/502; 428/107, 109, 110, 257, 272, 273, 288, 290, 294, 296, 902

[56] References Cited

U.S. PATENT DOCUMENTS

| | | | |
|---|---|---|---|
| 3,458,905 | 8/1969 | Dodson et al. . | |
| 4,070,235 | 1/1978 | Marshall . | |
| 4,127,624 | 11/1978 | Keller et al. | 528/502 |
| 4,144,370 | 3/1979 | Boulton . | |
| 4,198,561 | 4/1980 | Keller et al. | 264/23 |
| 4,403,069 | 9/1983 | Keller et al. | 264/23 |

*Primary Examiner*—James C. Cannon

*Attorney, Agent, or Firm*—M. E. Lachman; A. W. Karambelas

[57] ABSTRACT

Disclosed is a process for preparing novel multidirectional fiber arrays wherein graphite, glass or other fibers, in unidirectional arrays, are interconnected with polymer fibers. Production is accomplished by mechanical agitation of these unidirectional arrays in cooling polymer solutions. The interconnected material may subsequently be layered, impregnated with resin and laminated to yield unidirectional fiber/resin/polymer fiber composites.

21 Claims, 4 Drawing Figures

INTERCONNECTION OF UNIDIRECTIONAL FIBER ARRAYS WITH RANDOM FIBER NETWORKS

BACKGROUND OF THE INVENTION

1. Field of the Invention

The present invention relates, in general, to novel multidirectional fiber arrays and, in particular, to unidirectional arrays of graphite, glass or other fibers interconnected with polymer fibers. The invention further involves a process of preparing the multidirectional fiber arrays by the mechanical agitation of the unidirectional arrays in cooling polymer solutions. In addition, the invention is directed to composites of these multidirectional arrays in solid polymeric matrices.

2. Description of the Prior Art

Known fiber/resin composites are fabricated by resin impregnation of unidirectional or crosswoven arrays of graphite, glass or other fibers. The inherent weakness of such composites is that while the fibers provide reinforcement in their axial directions, there is no reinforcement in the transverse direction, between fibers and between laminations.

U.S. Pat. No. 4,127,624 to Keller et al, the disclosure of which is incorporated herein by reference, is directed to forming new random three-dimensional polymeric fiber masses by mechanical agitation of cooling polymer solutions under controlled conditions. No suggestion was made in Keller et al, however, for utilizing their technique of precipitating the polymer in three dimensional, interconnected networks of high strength fibers to interconnect and reinforce larger unidirectionally strung graphite, glass and other fibers or to possibly reinforce the interlaminar region between layers of such larger fibers.

Production of two- or three-dimensional arrays in which graphite, glass or other fibers provide strength in one direction while interconnected polymer fibers provide it in the other(s), as well as fabrication of composites of these materials impregnated with resin, have, heretofore, been impossible.

The present invention advantageously provides novel multidirectional fiber arrays comprising unidirectional or cross-woven arrays of graphite, glass or other fibers interconnected with polymer fibers, as well as a process for preparing said novel fiber arrays.

This invention advantageously also provides novel unidirectional fiber/resin/polymer composites.

This invention advantageously further provides multidirectional fiber arrays and fiber/resin composites which are reinforced in both the axial and transverse directions.

This invention advantageously still further provides fiber arrays wherein microscopic polymer fibers of high strength and elongation are deposited to interconnect, larger, unidirectionally strung fibers.

SUMMARY OF THE INVENTION

The foregoing advantages, and others, are accomplished in accordance with this invention, generally speaking, by providing novel multidirectional fiber arrays wherein graphite, glass or other fibers, in substantially unidirectional arrays, are interconnected with polymer fibers. These novel materials are produced by mechanical agitation of the unidirectional arrays in cooling polymer solutions. Mechanical agitation may be continued until the polymer solutions are supercooled (i.e., cooled below their normal precipitation points). The interconnected material may subsequently be layered, impregnated with resin and laminated to yield unidirectional fiber (e.g., graphite)/resin/polymer fiber composites.

BRIEF DESCRIPTION OF THE INVENTION

When cooling solutions of highly crystalline polymers are subjected to mechanical agitation, the polymer molecules precipitate into three-dimensional, interconnected random fiber networks, as demonstrated in U.S. Pat. No. 4,127,624. It has now been demonstrated that the process may be used to interconnect two- or three-dimensional arrays of unidirectionally-orientated graphite, glass or other fibers. Interconnected arrays are obtained by mechanical agitation of non-interconnected fiber arrays in cooled polymer solutions. As agitation causes polymer fiber formation, the graphite, glass or other fibers become interconnected by microscopic polymer fibers.

Figure 1:
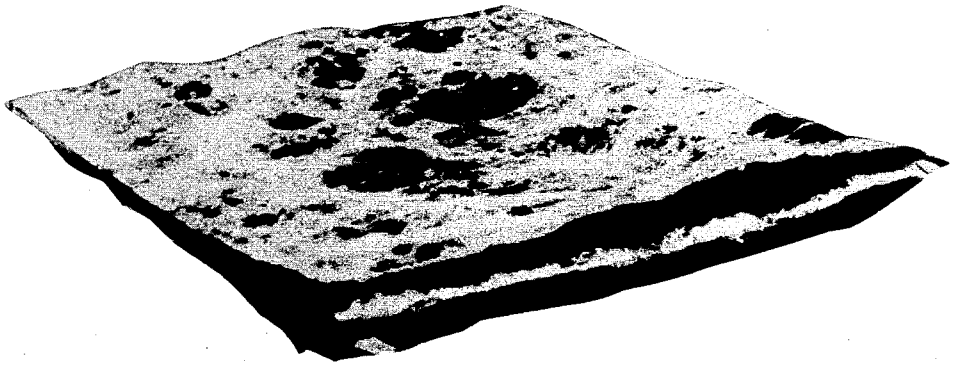
FIG 1 is a photograph of two parallel sheets of graphite fibers interconnected with polypropylene fibers.
Figure 2:
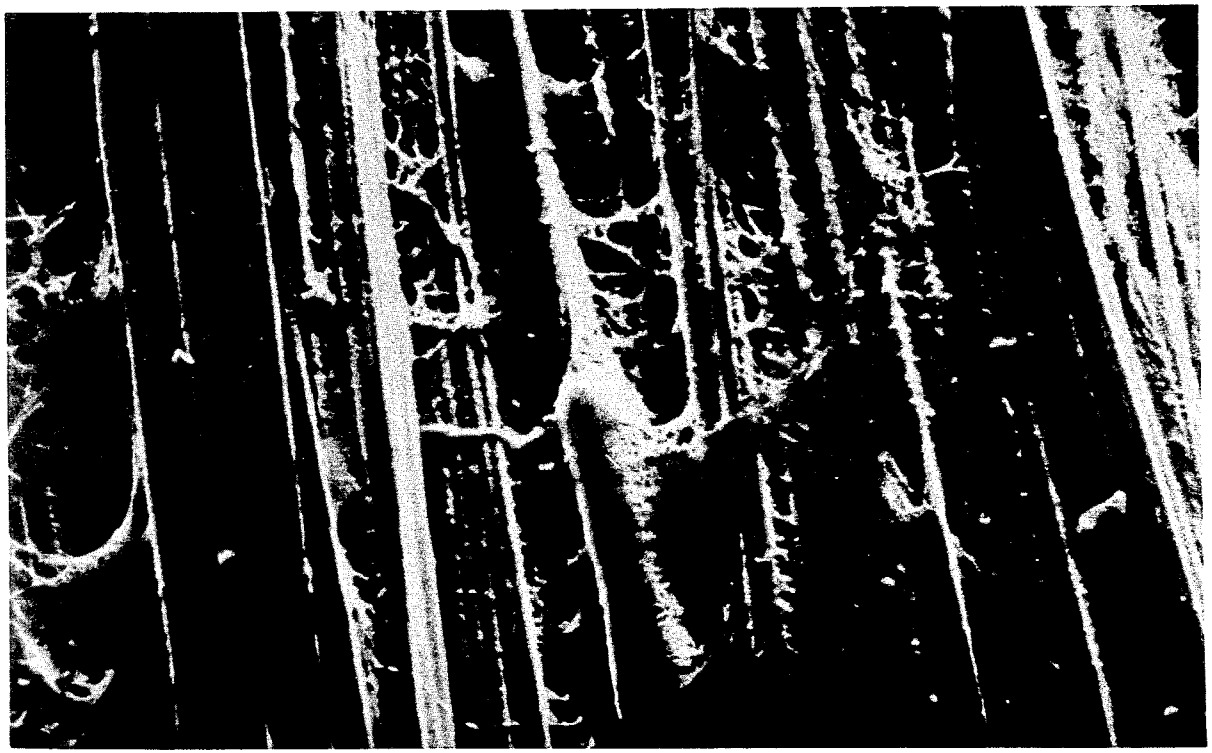
FIG. 2 is a scanning electron micrograph of polypropylene fibers deposited on graphite fibers at a magnification of 180×.
Figure 3:
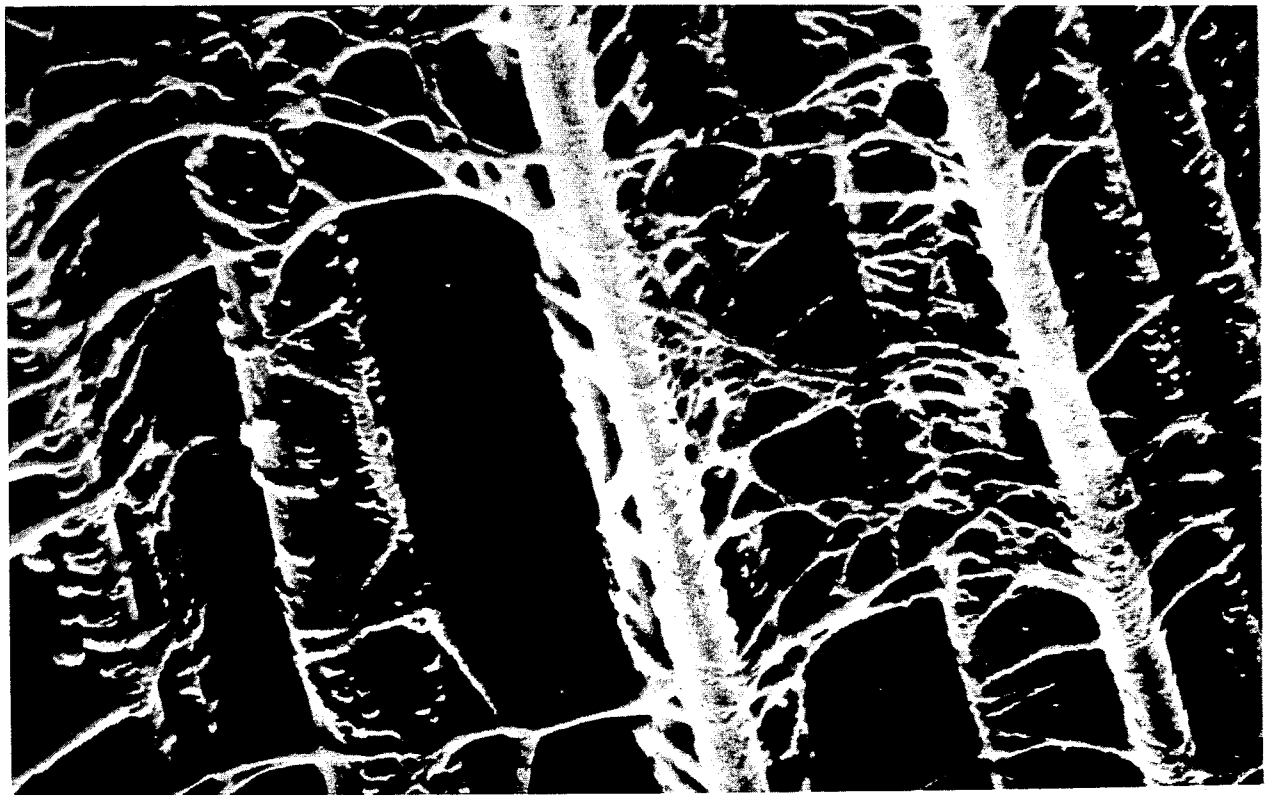
FIG. 3 is a scanning electron micrograph of polypropylene fibers deposited on graphite fibers at a magnification of 900×.
Figure 4:
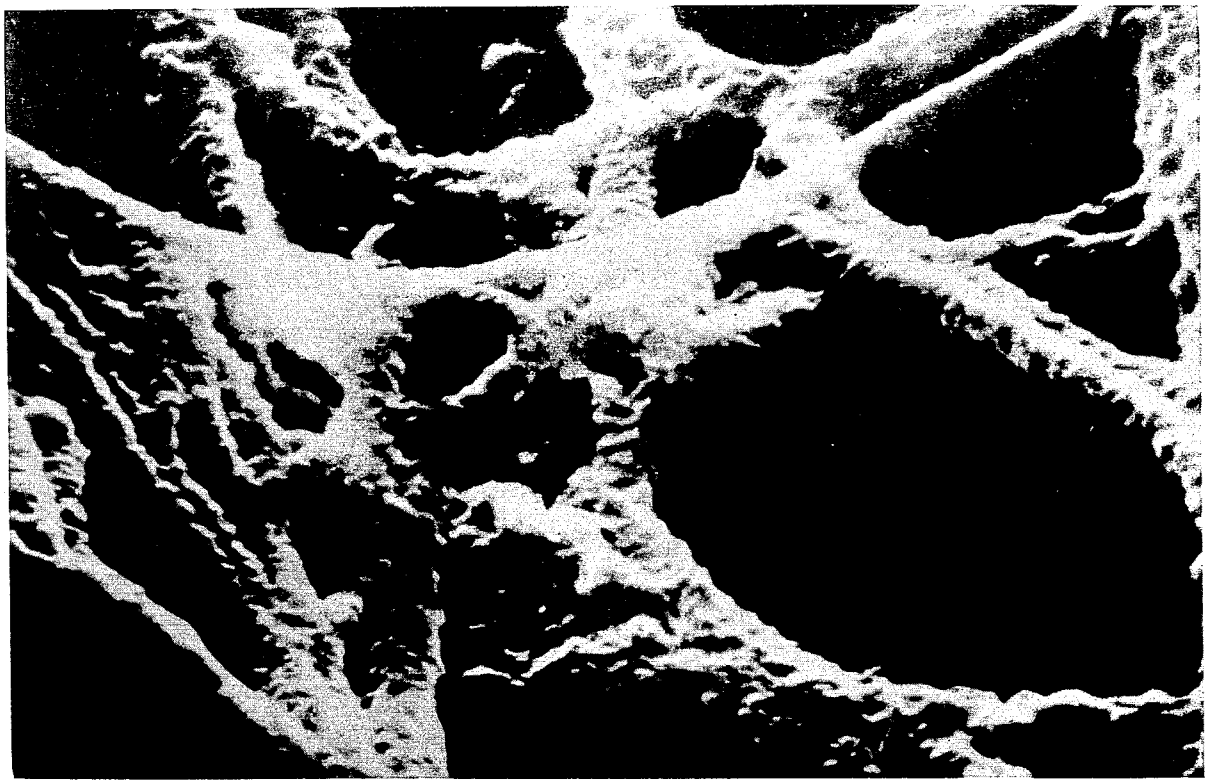
FIG. 4 is a scanning electron micrograph of polypropylene fibers deposited on graphite fibers at a magnification of 4500×.

A photograph of a graphite fiber/polymer fiber array is shown in FIG. 1. The fiber array was obtained by agitating graphite fibers, bonded to plastic frames, in about a 2% solution of isotactic polypropylene in mixed xylenes at about 102° C. The agitations were conducted at approximately 50 Hz, with a peak-to-peak displacement of approximately 0.2 to 0.4 inch. FIGS. 2, 3 and 4 are scanning electron micrographs at 180×, 900×, and 4500× magnifications, respectively, of a smaller but similarly prepared sample. These show how the very small graphite fibers are interconnected by the even smaller polymer fibers.

Any suitable unidirectional fiber material may be used in the present invention. Typical unidirectional fiber materials include graphite, glass, boron, aramid, nylon, carbon, aluminum oxide and other high strength high modulus fibers. While any suitable unidirectional fiber material may be used herein, very good results have been obtained with use of graphite and glass fiber materials. These unidirectional fiber materials are usually formed by laying threads or rovings, made up of a multiplicity of individual fibers, side by side in a parallel array to form a flat sheet. The invention is also intended to include the logical extension of this unidirectional array of parallel rovings to arrays with tie threads in the direction perpendicular to the fiber array. Moreover, the invention is also intended to cover cross-woven arrangements of rovings and threads.

Any suitable fiber-forming polymeric material may be used to prepare the multidirectional interconnected fiber array of the present invention. Typical of such polymeric materials are any of those used heretofore to produce polymeric fibers. While any suitable fiber-forming polymeric material may be used herein, it is preferred to use those which are linear, organic polymers having a regularly repeated chain structure and a high degree of crystallinity as determined by X-ray diffraction. Highly crystalline polymers such as, for example, isotactic polypropylene are particularly useful in this invention and, accordingly, are preferred. Fiber masses consisting essentially of nylon, polyethylene and other polyalkenes have been successfully produced and are, therefore, suitable. Typical polyalkenes include, among others, polyethylene, isotactic polypropylene, isotactic poly(4-methylpentene-1), isotactic poly (1-butene), isotactic polystyrene, and mixtures thereof.

The process of preparing the multidirectional fiber array of the present invention, comprising unidirectional fibers interconnected with high strength polymer fibers, comprises placing the unidirectional fibers in a solution comprising fiber-forming polymeric material in a solvent, cooling the resultant solution, and subjecting it to sonic vibrations. Typically, the solution is cooled to a specific temperature or series of progressively lower temperatures in the supercooled region for that particular polymer solution. The temperature is then maintained isothermally at these optimum fiber-forming temperatures while the fibers are forming.

Any suitable polymerizable or non-polymerizable solvent may be used in the process of this invention. Typical polymerizable solvents include styrene, acrylic acid, divinylbenzene, methylmethacrylate and allylglycidyl ether, among others. Typical non-polymerizable solvents include xylene, toluene, and kerosene, among others. Obviously, the choice of solvent will depend on various factors such as the nature of the solute. For economical reasons, one generally prefers to use a non-polymerizable solvent. When a polymerizable solvent is employed, it is usually advantageous to include an inhibitor such as, for example, hydroquinone, when styrene is used, to prevent or retard the polymerization of the solvent.

It is usually necessary to heat the solvent in order to dissolve an adequate amount of the polymeric fiber-forming material therein. The solution is then allowed to cool slowly while it is simultaneously subjected to vibrations. The solution will preferably contain from about 1% to about 20%, by weight, of polymeric fiber-forming material. The upper limit may be dictated by the limit of solubility of the fiber-forming material.

A variable frequency range of vibration may be more effective than a single frequency. Optimum frequencies are those which produce maximum agitation of the solution. Frequencies from about 40 Hz to about 200 Hz are preferred. Once the interconnected fiber array is produced, the solvent may be removed by routine methods, depending on the nature of the solvent. For example, a volatile solvent may be removed by simple evaporation, while a relatively non-volatile solvent can be washed out with a volatile liquid, the traces of which can then be evaporated.

The interconnected multidirectional fiber arrays may be impregnated with a resin and laminated to form fiber-reinforced composites. State-of-the-art fiber/resin components are fabricated by resin impregnation of unidirectional or cross-woven arrays of glass, graphite, or other fibers. The inherent weakness of such composites is that, while the fibers provide reinforcement in their axial directions, there is no reinforcement in the transverse direction, between laminae. However, by use of the process of the present invention, microscopic polymer fibers of high strength and elongation can be deposited to interconnect the larger unidirectionally strung fibers and, possibly, to reinforce the interlaminar layer.

The following examples further define and illustrate the present invention. They are not intended, in any manner, to limit the invention.

EXAMPLE I

Graphite fibers are bonded to glass/epoxy frames which have 10 inch by 5 inch inside dimensions. The graphite fibers are commercially available Celion-3000 fibers, unsized, with diameters of approximately 10 to 12 μm. Fibers are oriented along the long dimension of the frames. Fiberizations are conducted according to the following process:

(a) Arrays are fiberized in a 1.5% (weight to volume) solution of polypropylene in mixed xylenes at 380 K (225° F.). Two arrays are agitated simultaneously, side by side, separated by approximately 2½ cm. An oscillation frequency 54 Hz and a peak-to-peak displacement of approximately ½ cm are used. Arrays are oscillated up and down in a direction parallel to their surfaces, and perpendicular to the fibers.

(b) After approximately 15 minutes of agitation and cooling, fresh concentrated polymer solution is added to replace precipitated material and agitation is resumed for another 15 minutes.

(c) The fiberization chamber is drained of solution and refilled with hot solvent. Low-frequency agitation is then conducted to remove non-fibrous precipitate.

(d) Arrays are extracted with acetone in a Soxhlet extractor and then dried.

EXAMPLE II

The same process as described in Example I is employed except that Celion-3000 fibers with conventional Celanese epoxy-compatible sizing and fiber bundle twist are employed. Similar results are obtained.

EXAMPLE III

The same process as described in Example I is employed, except that sized Celion-6000 fibers are employed. Again, similar results are obtained.

EXAMPLE IV

The same process as described in Example I is employed, except that the graphite fibers are bonded on the frame oriented along the short frame dimension. The direction of agitation is thus parallel to the array surface and parallel to the fiber direction. Similar results are obtained.

EXAMPLE V

The same process as described in Example I is employed, except that the graphite is bonded on the frame oriented diagonally, at 45° to each of the principal axes of the frame. The agitation direction is thus at 45° to the fiber direction. Similar results are obtained.

EXAMPLE VI

The same process as described in Example I is employed, except that cross-woven graphite fiber cloth (sized) is used rather than unidirectional fibers. Similar results are obtained.

EXAMPLE VII

Example I is repeated using polyethylene in place of polypropylene, decahydronaphthlene in place of xylene and 373 K in place of 380 K. Similar results are obtained.

EXAMPLE VIII

Example I is repeated using polychlorotrifluoroethylene in place of polypropylene, 2,4-dichlorobenzotrifluoride in place of xylene and 100 K in place of 380 K. Similar results are obtained.

EXAMPLE IX

Example I is repeated using glass fibers in place of graphite fibers. Similar results are obtained.

While specific components of the present system are defined in the examples above, many other variables may be introduced which may in any way affect, enhance or otherwise improve the invention. These are intended to be included herein. Further, while variations are given in the present application, many modifications and ramifications will occur to those skilled in the art upon reading the present disclosure. These, too, are intended to be included herein.

What is claimed is:

1. A multidirectional fiber array comprising high strength, high modulus unidirectional fibers interconnected with random fiber networks of high strength polymer fibers.

2. The array of claim 1 wherein the array of said unidirectional fibers is two-dimensional.

3. The array of claim 1 wherein the array of said unidirectional fibers is three-dimensional.

4. The array of claim 1 wherein said unidirectional fibers are selected from the group consisting of graphite fibers, glass fibers and mixtures thereof.

5. The array of claim 1 wherein polymer fibers are highly crystalline.

6. The array of claim 5 wherein said polymer fibers consist essentially of polypropylene.

7. The interconnected array of claims 1, 2, 3, 4, 5 or 6, further impregnated with a resin material and laminated to produce a composite material.

8. A process for preparing a multidirectional fiber array comprising unidirectional fibers, interconnected with high strength polymer fibers, which comprises placing unidirectional fibers in a solution comprising fiber-forming polymeric material in a solvent, and cooling the resultant solution while subjecting it to the application of sonic vibrations.

9. The process of claim 8 wherein said resultant solution is supercooled.

10. The process of claim 8 wherein said unidirectional fibers are selected from the group consisting of graphite fibers, glass fibers and mixtures thereof.

11. The process of claim 8 wherein said polymer fibers are highly crystalline.

12. The process of claim 8 wherein said solvent is a non-polymerizable solvent.

13. The process of claim 8 wherein said solvent is a polymerizable solvent.

14. The process of claim 12 wherein said solvent is xylene.

15. The process of claim 13 wherein said solution further includes an inhibitor material to retard polymerization of the solvent.

16. The process of claim 13 wherein said solvent is styrene and said fiber-forming polymeric material is isotactic polypropylene.

17. The process of claim 13 wherein said solvent is a mixture of styrene and methylmethacrylate and said fiber-forming polymeric material is isotactic polypropylene.

18. The process of claim 13 wherein said solvent is a mixture of styrene, methylmethacrylate and acrylonitrile and said fiber-forming polymeric material is isotactic polypropylene.

19. The process of claim 16, 17 or 18 wherein said solution further includes hydroquinone.

20. The process of claim 13 wherein the resultant solution contains a cross-linking agent for the polymerizable solvent.

21. The process of claim 20 wherein the fiber-forming polymeric material is a polyalkene.

* * * * *